US005119012A

United States Patent [19]

Okamura

[11] Patent Number: 5,119,012

[45] Date of Patent: Jun. 2, 1992

[54] AC POWER REGULATOR WITH TAP CHANGER

[75] Inventor: Michio Okamura, Yokahama, Japan

[73] Assignee: Jeol Ltd., Tokyo, Japan

[21] Appl. No.: 511,035

[22] Filed: Apr. 19, 1990

[51] Int. Cl.[5] ..... G05F 1/16

[52] U.S. Cl. ..... 323/258; 323/343

[58] Field of Search ..... 323/282, 283, 288, 351, 323/258, 343; 363/20, 21, 127

[56] References Cited

U.S. PATENT DOCUMENTS

| | | | |
|---|---|---|---|
| 3,818,321 | 6/1974 | Willner et al. | 323/258 |
| 3,913,002 | 10/1975 | Steigerwald et al. | 323/205 |
| 4,240,135 | 12/1980 | Schaefer | 323/258 |
| 4,523,265 | 6/1985 | Deprez | 323/258 |
| 4,623,834 | 11/1986 | Klingbiel et al. | 323/258 |
| 4,896,092 | 1/1990 | Flynn | 323/258 |
| 4,916,329 | 4/1990 | Dang et al. | 323/344 |

*Primary Examiner*—Jeffrey Sterrett

*Attorney, Agent, or Firm*—Webb, Burden, Ziesenheim & Webb

[57] ABSTRACT

An AC power regulator having a tap changer. The regulator comprises a transformer having taps and thyristors connected with the taps, respectively. The regulator further includes rectifiers, comparators having hysteresis and comparing the output signals from the rectifiers with a reference voltage, a priority processing circuit for selecting the signal to which the highest priority is given out of the output signals from the comparators, firing circuits for firing the thyristors, respectively, and zero voltage-detecting circuits for detecting the voltages between the terminals of the thyristors. When the detected voltages are all nonzero, the conducting thyristor is switched to the next thyristor.

2 Claims, 3 Drawing Sheets

AC POWER REGULATOR WITH TAP CHANGER

FIELD OF THE INVENTION

The present invention is related to an AC power regulator comprising a transformer equipped with plural taps connected to respective switching devices which are selectively turned on to regulate the output voltage.

BACKGROUND OF THE INVENTION

The rated voltage, the range of the fluctuating voltage, and other factors of an AC power line vary from region to region. For example, the rated voltages vary among countries, such as 100V and 115V.

For many electronic instruments energized with alternating current, voltage changes must be limited severely. If such instruments energized with alternating current are used in other regions having different power supply ratings, it is necessary either to modify the specifications of the instruments according to the ratings or to connect a power regulator.

If the design of an instrument is modified according to the power ratings in the regions where the instrument is used, printed-wiring boards and various components included in the instrument can no longer be used in common because of the modification of the power rating. Therefore, other components must be prepared according to the modified power ratings. As a result, the manufacturing costs increase, as well design costs. Also, a heavy burden is imposed to control over components and the manufacturing yield deteriorates.

One conceivable method of solving the above-described problems is to use power regulators. This method permits standardization of instruments. However, since the ratings differ among regions or countries as described above, power regulators having wide control ranges, i.e., expensive power regulators, are needed. Where voltages fluctuate within wide ranges, they are often employed at low efficiencies and hence operate inefficiently. In addition, the system is made large and complex. Furthermore, the maintenance costs and the running costs are increased.

SUMMARY OF THE INVENTION

In view of the foregoing, it is an object of the present invention to provide an AC power regulator which is equipped with a tap changer, simple in structure, and capable of efficiently regulating voltages.

The above object is achieved in accordance with the teachings of the invention by an AC power regulator having a tap changer, said AC power regulator comprising: a transformer having a plurality of taps; switching devices which are connected to the taps, respectively, and are selectively turned on, for regulating the voltage applied across a load; means for detecting the voltage between the terminals of each of the switching devices; means for detecting changes in the voltage applied across the load; means for producing signals to selectively turn on the switching devices according to the changes in the voltage applied across the load; and control means which, when the voltages between the terminals of the switching devices are all nonzero, permits the conducting switching device to be switched to another switching device.

The above object is also achieved by an AC power regulator having a tap changer, said AC power regulator comprising: a transformer having a plurality of taps; switching devices which are connected with the taps, respectively, and are selectively turned on, for regulating the voltage applied across a load; a signal-producing means including comparator circuits having hysteresis, the comparator circuits acting to compare voltages applied across the load with a reference voltage, the signal-producing means producing a signal supplied to the gate of the switching device that should conduct; and a control means which detects the voltage between the terminals of each of the switching devices and which, when the detected voltages are all nonzero, produces gate control signals to selectively turn on the switching devices.

In the novel AC power regulator, when a signal for turning on the next switching device is produced according to the change in the voltage applied across the load, the voltage between the terminals of the presently conducting switching device remains zero unless the conducting device is biased to cutoff. Therefore, the conducting device is not switched to the next device. It is unlikely that plural switching devices conduct simultaneously, thus short-circuiting plural taps. When all the switching devices are biased to cutoff and the voltages between the terminals of the devices are all nonzero, the conducting device is immediately switched to the next device. The signal-producing means for producing signals supplied to the gates of switching devices includes comparator circuits having hysteresis. Each comparator circuit compares the voltage applied across the load with the reference voltage and, therefore, if the detected voltages are affected by the switching action of the conducting device, the condition is maintained as long as the detected voltage lies within a given range. Hence, hunting or other undesirable phenomenon is prevented when the conducting device is switched from one to another.

Other and further objects of the invention will become clear upon an understanding of the illustrative embodiments described hereinafter or in the appended claims, and various advantages not referred to herein will occur to one skilled in the art upon employment of the invention in practice.

DETAILED DESCRIPTION OF THE INVENTION

Figure 1:
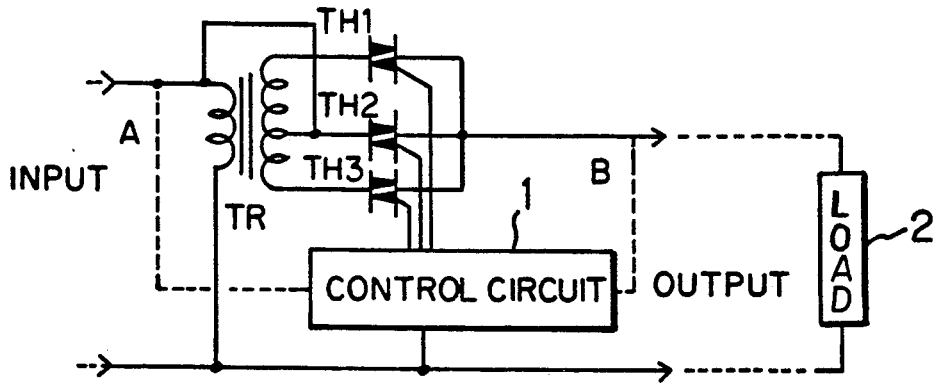
FIG. 1 is a diagram of an AC power regulator which has a tap changer and is fabricated in accordance with the invention.

Referring to FIG. 1, there is shown an AC power regulator according to the invention, the regulator being equipped with a tap changer. This AC power regulator comprises a control circuit a transformer TR, and thyristors TH1–TH3. A load 2 is connected as shown.

The transformer TR has taps for switching the output voltage between different values. The center tap of the secondary winding is connected to the input terminal of the primary winding. The load 2 is fed from the terminals of the secondary winding through the switching thyristors TH1–TH3, respectively. These switching devices TH1–TH3 are so controlled that any one of them conducts. Thus, the load voltage can be made higher or lower than the supply voltage by the tap voltage. The thyristors TH1–TH3 are bidirectional switching devices and can be triacs. Also, the switching devices can be parallel circuits consisting of unidirectional thyristors, transistors, or other semiconductor rectifying devices.

The control circuit 1 detects either the supply voltage A or the load voltage B and selectively turns on the thyristors TH1–TH3 such that the load voltage B lies within a given range. For this purpose, the control circuit 1 comprises a reference voltage-generating circuit for producing a reference voltage for the load voltage B, a comparator circuit for comparing the supply voltage A or the load voltage B with the reference voltage, and firing circuits which select for conducting one of the thyristors TH1–TH3 according to the result of the comparison and supply a firing signal to the selected thyristor at given timing.

Figure 2:
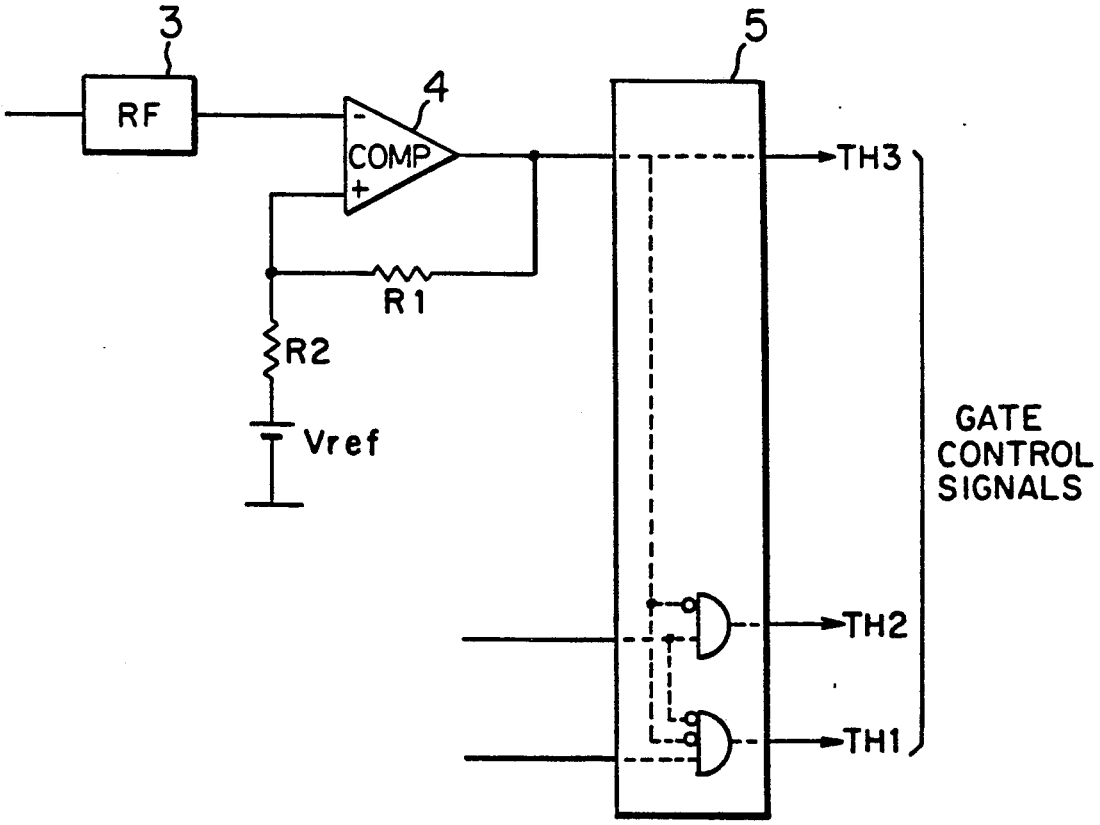
FIG. 2 is a diagram of a gate control signal-producing circuit.

A circuit which detects a voltage and produces gate control signals is shown in FIG. 2. This circuit comprises rectifier circuits 3 (only one is shown), comparator circuits 4 (only one is shown), a priority processing circuit 5, resistors R1, R2, and a source of a reference voltage Vref. The illustrated comparator circuit 4 compares the output voltage from the illustrated rectifier circuit 3 with the reference voltage Vref. The comparator circuit 4 cooperates with the resistors R1 and R2 to form a comparator that shows hysteresis, in order to prevent hunting when the tap is switched to another tap. The rectifier circuit 3 is connected to the primary winding of the transformer TR shown in FIG. 1. The rectifier circuit 3 acts to rectify and smooth the supply voltage and to step down the voltage according to the rating of the comparator circuit 4. Since a feedforward control system that detects and adjusts the supply voltage is formed, similar circuits are necessary, corresponding to the taps.

The priority processing circuit 5 selects the signal of the highest priority. In the example shown in FIG. 1, if the supply voltage is low, thyristor TH1 is caused to conduct to increase the output voltage. As the supply voltage increases, the conducting device is switched from thyristor TH1 to thyristor TH2. When the supply voltage increases further, the conducting device is switched from thyristor TH2 to thyristor TH3. When the supply voltage is so high that thyristor TH3 conducts, any comparator circuit delivers a signal indicating that the supply voltage is higher than the reference voltage. The priority processing circuit 5 receives such signals and processes only the gate control signal which is supplied to thyristor TH3 and to which the top priority is given.

The above-described feedforward control system can be replaced by a feedback control system in which the load voltage B is applied to the rectifier circuit 3. In this case, only the rectifier circuit and two comparator circuits are needed; the priority processing circuit is dispensed with. One of these two comparator circuits determines whether the voltage is in excess of the upper limit, while the other comparator circuit determines whether the voltage is lower than the lower limit. In this case, however, the system must be so controlled that whenever the load voltage B exceeds the upper limit, the connected tap is shifted to a lower one, and that whenever the load voltage B drops below the lower limit, the connected tap is switched to a higher one. Therefore, an instrument is needed which holds information about the positions of the taps and determines the next connected tap according to the output signals from the comparator circuits. A specific example of this instrument is an up/down counter. In this case, the up/down counter counts upward in response to a signal indicating a higher tap with the signal delivered from one comparator circuit. The up/down counter counts downward in response to a signal indicating a lower tap with the signal delivered from the other comparator circuit. Gate control signals can be selectively produced by making the contents of the counter correspond to the connected tap position.

It is known that the desired tapping of a transformer having a tap changer can be switched by means of semiconductor rectifying devices such as thyristors to control the voltage. In this configuration, a circuit which switches the semiconductor rectifying devices from one to another poses problems. In particular, where one thyristor is switched to another, devices having a large capacity are required. Generally, the switch is made at the crosspoint where the electric current is zero. It is now assumed that thyristor TH1 is conducting and that the load is fed. If the voltage increases and the conducting device is about to be switched from thyristor TH1 to thyristor TH2, the supply of a firing signal to the thyristor TH1 is stopped. A firing signal is supplied to the next thyristor TH2 provided that the electric current flowing through thyristor TH1 drops down to zero. In the past, the thyristors have been controlled in this way. To smoothen the switching action, current-detecting means or arc-suppressing coils are connected in series with the thyristors in the load circuit. In practice, other circuits are thus added to the main circuit through which the load current flows, as well as to the thyristors. This prevents plural thyristors from conducting at the same time, thus preventing a short circuit between plural taps and promoting extinguishment of thyristors. As the capacity of the power supply increases, the capacity of these additional circuits also increases. Also, the system becomes larger, increasing the costs.

In contrast with these conventional circuits, in the novel AC power regulator equipped with a tap changer, reactors and current-detecting circuits are omitted from the load circuit; only the thyristors TH1–TH3 are connected with the main circuit. Therefore, the voltages between the thyristors TH1–TH3 are detected. Any one of the thyristors is fired provided that all of these voltages are nonzero. A timing bus control circuit which controls the thyristors in this manner is shown in FIG. 3.

Figure 3:
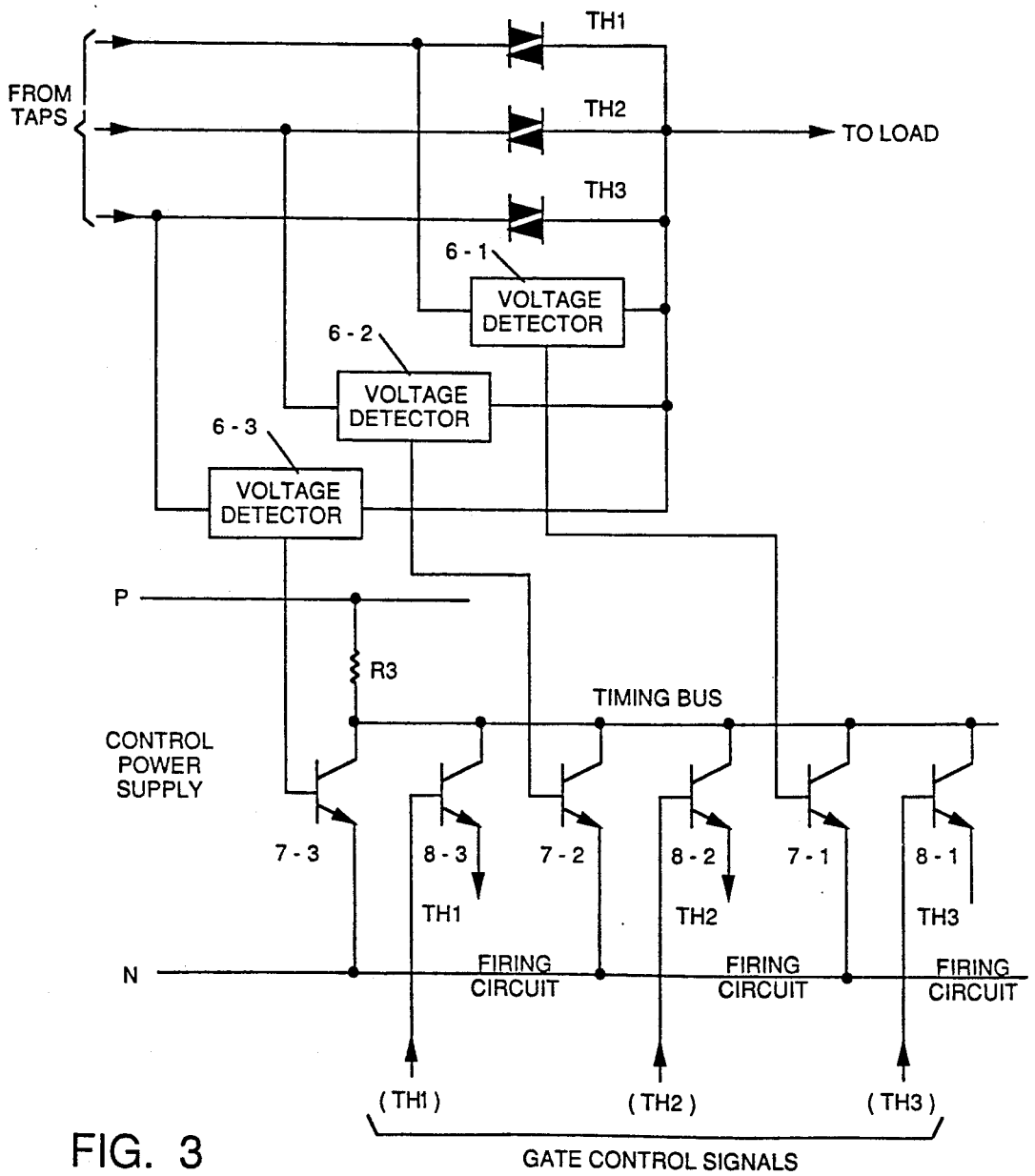
FIG. 3 is a diagram of a timing bus control circuit for processing gate control signals.

Referring to FIG. 3, zero voltage-detecting circuits 6-1, 6-2, and 6-3 detect the voltages between the terminals of the thyristors TH1–TH3, respectively, and act to control timing bus control transistors 7-1, 7-2, and 7-3, respectively. The transistors 7-1, 7-2, 7-3 are connected in parallel with a control power supply PN via a resistor R3 to form a wired OR circuit. A timing bus is connected to the junctions of the resistor R3 and the transistors 7-1, 7-2, 7-3. Gate-controlled transistors 8-1, 8-2, 8-3 which are turned on or off by gate control signals and operate the firing circuits are connected with this timing bus.

The operation of the circuit shown in FIG. 3 is now described. When any one of the thyristors TH1–TH3 is conducting, the voltage between the terminals of the conducting thyristor is zero. As an example, if thyristor TH1 is conducting, the zero voltage-detecting circuit 6-1 detects zero voltage. The output signal from this detecting circuit turns on transistor 7-1. Under this condition, if a gate control signal for thyristor TH2 turns on gate-controlled transistor 8-2, no firing signal is supplied to thyristor TH2, because conducting transistor 7-1 places the timing bus at the same potential as the negative terminal of the control power supply PN.

When the conducting device is switched from thyristor TH1 to thyristor TH2, the gate control signal fed to thyristor TH1 is caused to go low, while the gate control signal supplied to thyristor TH2 is made to go high. As a result, if the electric current flowing through thyristor TH1 passes across the zero point, it is not fired again. Then, the voltage between the terminals of thyristor TH1 increases sinusoidally from zero until zero voltage is no longer detected by zero voltage-detecting circuit 6-1. At this time, timing bus control transistor 7-1 is biased to cutoff. Therefore, all the timing bus control transistors 7-1, 7-2, 7-3 are off. Meanwhile, gate-controlled transistor 8-2 is biased to conduct because the gate control signal is applied to thyristor TH2. When all the timing bus control transistors 7-1, 7-2, 7-3 are turned off, a voltage is applied to the firing circuit through gate-controlled transistor 8-2. The result is that thyristor TH2 is turned on.

As described above, the timing bus is controlled by the timing bus control transistors 7-1, 7-2, 7-3 connected with the zero voltage-detecting circuits 6-1, 6-2, 6-3 through the wired OR circuit. Therefore, the tap switching for voltage regulation can be performed smoothly with the simple circuit configuration. Further, the next thyristor can be fired without delay of firing timing. That is, after the previous thyristor is extinguished, the next thyristor can be fired only if the time taken for the voltage between the terminals to reach a given level is short.

Figure 4:
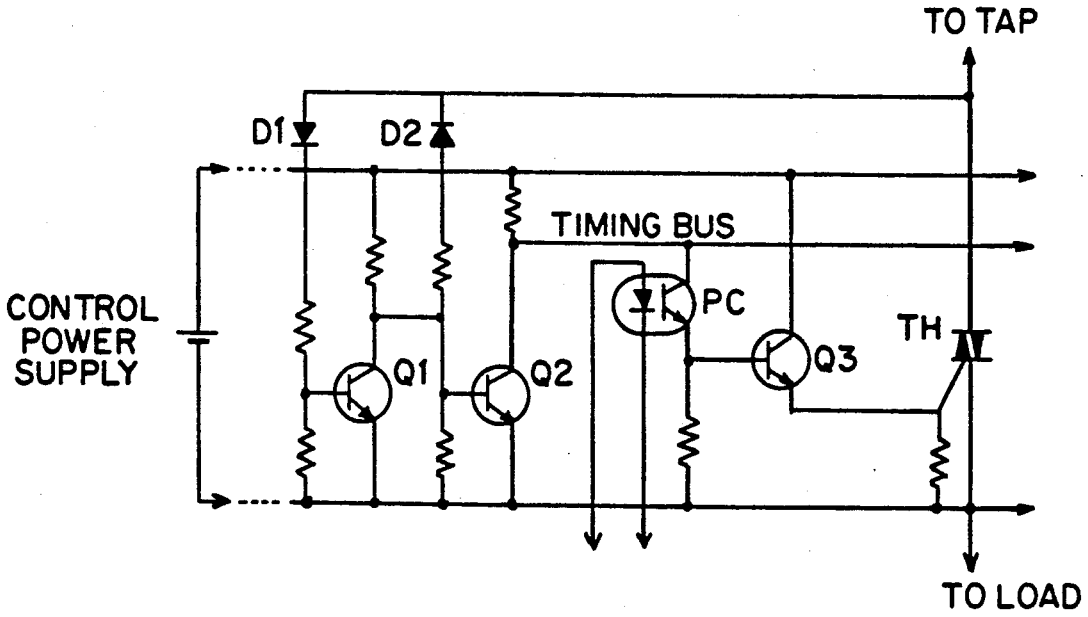
FIG. 4 is a diagram of a circuit which controls firing of each thyristor.

FIG. 4 shows a circuit which controls the firing of each thyristor. This circuit includes diodes D1, D2, and a transistor Q1 which together constitute a zero voltage-detecting circuit. Another transistor Q2 controls a timing bus. A gate control signal is applied to a photocoupler PC consisting of a photodiode and a phototransistor. The output signal from the photocoupler PC turns on or off a transistor Q3 included in a firing circuit.

In the operation of this circuit, when the voltage between the terminals of a triac TH is zero, transistor Q1 is off. In this state, a bias is supplied to the base of transistor Q2 from a control power supply. Therefore, the timing bus is at the same potential as the negative terminal of the control power supply. When the voltage between the terminals of the triac TH ceases to be zero, if the potential at the tap (in an upper position in the figure) is positive, the voltage is applied as a bias to the base of transistor Q1 through diode D1. Transistor Q1 conducts, causing a short circuit between the base and the emitter of transistor Q2. As a result, transistor Q2 is turned off. If the potential at the load is positive, the voltage is applied as a reverse bias between the base and the emitter of transistor Q2 through diode D2, so that transistor Q2 is biased off. In this way, circuits (not shown) which control the firing of triacs are connected via a wired OR circuit. When the transistors included in these control circuits are all turned off, the output from the photocoupler PC turns on transistor Q3 to allow firing signals to be supplied to the triacs TH.

It is to be understood that the present invention is not limited to the above example and that various changes and modifications may be made. In the above example, the secondary winding of the transformer has three terminals. Obviously, the invention can be similarly applied to a transformer whose secondary winding has four or more terminals. The circuits shown in FIGS. 3 and 4 can be replaced with any other circuit as long as it can detect the voltages between the terminals of each thyristor and supply a firing signal to the selected thyristor if the voltages between the terminals of the thyristors are all nonzero. Moreover, the invention is applicable to other transformers such as a transformer having switched taps on the primary winding.

As can be understood from the description made thus far, in accordance with the present invention, the voltages between the terminals of each of plural switching devices connected in parallel are detected, and the devices are selectively turned on. Therefore, current-detecting means that sense whether the switching devices are turned off are dispensed with. Also, arc-suppressing coils or other similar means can be dispensed with, because the next switching device is turned on only after a cutoff condition of all the switching devices is detected certainly by the aforementioned detection of the voltages between the terminals. In this way, it is not necessary to add current-detecting means or impedance to the main circuit. This makes the circuit configuration of the whole apparatus simpler and reduces the size of the apparatus. Since cutoff of all the switching devices is detected by measuring the voltages between the terminals, the conducting device can be smoothly switched and switching noise will be reduced. Comparator circuits having hysteresis are employed to determine whether the conducting device should be switched to the next one. Consequently, if the voltage changes due to switching action of the switching devices, the condition is not varied as long as the voltage lies within a certain range. This assures stable operation of the apparatus.

Having thus described my invention with the detail and particularity required by the Patent Laws, what is desired and claimed to be protected by Letters Patent is set forth in the following claims.

What is claimed is:

1. An AC power regulator having a tap changer, comprising:

a transformer having a plurality of taps;

switching devices which are connected with the taps, respectively, and are selectively turned on for regulating the voltage applied across a load;

plurality detector circuits for detecting the voltages between the terminals of each of the switching devices and providing an output when the voltage is indicative of the switching devices being turned on;

means for detecting changes in the voltage applied across the load;

control means for producing signals to selectively turn on the switching devices according to the signals of said means for detecting changes in the voltage applied across the load;

a control power supply having output terminals;

a timing bus connected to one of the terminals of the control power supply;

gate controlled transistors for operating said switching devices in response to the signals produced by the control means, one terminal of each said gate controlled transistors being connected with said timing bus; and plurality of timing bus control transistors connected in parallel with said control power supply to form a wired OR circuit, each base of which is connected with one of said detecting circuits, wherein said each of timing bus control transistors places said timing bus at nearly the same potential as that of the other terminal of said control power supply when a detecting circuit detects conduction through any switching device disabling all gate controlled transistors.

2. The AC power regulator of claim 1, wherein each of said detecting circuits comprises a transistor (Q1) connected in parallel with said control power supply, said transistor (Q1) controls the voltages of said base of the timing bus control transistor by turning ON or OFF according to the voltage between the terminals of each of the switching devices.

* * * * *

UNITED STATES PATENT AND TRADEMARK OFFICE

CERTIFICATE OF CORRECTION

PATENT NO. : 5,119,012

DATED : June 2, 1992

INVENTOR(S) : Michio Okamura

It is certified that error appears in the above-identified patent and that said Letters Patent is hereby corrected as shown below:

Cover page, after [73] Assignee: "Jeol" should read --JEOL--.
and
after line [58] insert --[30] Foreign Application Priority Data
April 21, 1989 [JP] Japan ... 1-101946--.

Column 2 Line 61 after "circuit" insert --1,--.

Signed and Sealed this

Fourteenth Day of September, 1993

*Attest:*

*Attesting Officer*

BRUCE LEHMAN

*Commissioner of Patents and Trademarks*